US006881375B2

(12) United States Patent
Topolkaraev et al.

(10) Patent No.: US 6,881,375 B2
(45) Date of Patent: Apr. 19, 2005

(54) METHOD OF FORMING A 3-DIMENSIONAL FIBER INTO A WEB

(75) Inventors: Vasily Aramovich Topolkaraev, Appleton, WI (US); Bernhardt Edward Kressner, Appleton, WI (US); Gregory James Wideman, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 111 days.

(21) Appl. No.: 10/232,034

(22) Filed: Aug. 30, 2002

(65) Prior Publication Data

US 2004/0041307 A1 Mar. 4, 2004

(51) Int. Cl.[7] ..... D01D 5/092; D01D 5/12; D01D 5/22; D01D 5/34; D02G 1/18

(52) U.S. Cl. ..... 264/555; 156/167; 156/181; 264/103; 264/168; 264/171.1; 264/172.15; 264/210.8; 264/211.12; 264/211.14; 264/211.2; 264/342 RE

(58) Field of Search ..... 264/103, 168, 264/171.1, 172.15, 210.8, 211.12, 211.14, 211.2, 342 RE, 555; 156/167, 181

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,538 | A | 3/1970 | Petersen |
| 3,502,763 | A | 3/1970 | Hartmann |

(Continued)

FOREIGN PATENT DOCUMENTS

| | | | |
|---|---|---|---|
| DE | 2503775 | A1 | 8/1976 |
| DE | 25 13 251 | A1 | 9/1976 |
| EP | 0 064 853 | B1 | 7/1986 |

(Continued)

OTHER PUBLICATIONS

Manson, John A. and Leslie H. Sperling, "Biocomponent and Bioconstituent Fibers," *Polymer Blends and Composites*, Plenum Press, New York, Section 9.2, 1976, pp. 273–277.

"Fibers," Cargill Dow, Internet web page, "http://www.cargilldow.com/fibers.asp", viewed and printed Jul. 23, 2002, pp. 1–4.

"Olefin Polymers," *Kirk–Othmer Encyclopedia of Chemical Technology*, Fourth Edition, vol. 17, 1996, pp. 765–767.

"PLA Processing Guide for Bulked Continuous Filament (BCF)," Cargill Dow, Internet web page, "http://www.cargilldow.com/pdf/fiberguide.html", viewed and printed Jul. 23, 2002, pp. 1–3.

Lunt, James and Andrew L. Shafer, "Polylactic Acid Polymers from Corn Potential Applications in the Textiles Industry," *Journal of Industrial Textiles*, vol. 29, No. 3, Jan. 2000, pp. 191–205 (reprint pp. 1–8).

*Primary Examiner*—Leo B. Tentoni
(74) *Attorney, Agent, or Firm*—Thomas J. Connelly; Patricia A. Charlier

(57) ABSTRACT

A method includes the steps of co-extruding a first component and a second component. The first component has a recovery percentage $R_1$ and the second component has a recovery percentage $R_2$, wherein $R_1$ is higher than $R_2$. The first and second components are directed through a spin pack to form a plurality of continuous, molten fibers. The molten fibers are then muted through a quenching chamber to form a plurality of continuous cooled fibers. The coiled fibers are then routed through a drawing unit to form a plurality of continuous, solid linear fibers. Each of the solid fibers is then stretched by at least 50 percent before it is allowed to relax. The relaxation step forms the linear fibers into a plurality of continuous 3-dimensional fibers each having a coiled configuration over at least a portion of its length. The continuous 3-dimensional, coiled fibers are then deposited onto a moving support to form a web.

26 Claims, 6 Drawing Sheets

U.S. PATENT DOCUMENTS 3,542,615 A 11/1970 Dobo et al.
3,692,618 A 9/1972 Dorschner et al.
3,761,348 A 9/1973 Chamberlin
3,802,817 A 4/1974 Matsuki et al.
3,849,241 A 11/1974 Butin et al.
3,855,046 A 12/1974 Hansen et al.
3,988,883 A 11/1976 Sze
4,039,364 A 8/1977 Rasmussen
4,041,203 A 8/1977 Brock et al.
4,106,313 A 8/1978 Boe
4,116,892 A 9/1978 Schwarz
4,124,673 A 11/1978 Pieper et al.
4,136,218 A 1/1979 Nischwitz et al.
4,144,008 A 3/1979 Schwarz
4,153,751 A 5/1979 Schwarz
4,223,059 A 9/1980 Schwarz
4,243,802 A 1/1981 Landoll
4,251,585 A 2/1981 Schwarz
4,285,100 A 8/1981 Schwarz
4,301,102 A 11/1981 Fernstrom et al.
4,340,563 A 7/1982 Appel et al.
4,368,565 A 1/1983 Schwarz
4,374,175 A 2/1983 Tanaka
4,374,888 A 2/1983 Bornslaeger
4,405,686 A 9/1983 Kuroda et al.
4,422,892 A 12/1983 Plant
4,424,257 A 1/1984 Bach
4,475,971 A 10/1984 Canterino
4,517,714 A 5/1985 Sneed et al.
4,521,484 A 6/1985 Li
4,629,525 A 12/1986 Rasmussen
4,793,885 A 12/1988 Rasmussen
4,795,668 A 1/1989 Krueger et al.
4,806,300 A 2/1989 Walton et al.
4,861,660 A 8/1989 Ishii
4,863,785 A 9/1989 Berman et al.
4,992,124 A 2/1991 Kurihara et al.
5,028,289 A 7/1991 Rasmussen
5,057,368 A 10/1991 Largman et al.
5,064,802 A 11/1991 Stevens et al.
5,069,970 A 12/1991 Largman et al.
5,108,820 A 4/1992 Kaneko et al.
5,108,827 A 4/1992 Gessner
5,117,540 A 6/1992 Walton et al.
5,143,679 A 9/1992 Weber et al.
5,145,727 A 9/1992 Potts et al.
5,156,793 A 10/1992 Buell et al.
5,167,897 A 12/1992 Weber et al.
5,169,706 A 12/1992 Collier, IV et al.
5,178,931 A 1/1993 Perkins et al.
5,188,885 A 2/1993 Timmons et al.
5,256,417 A 10/1993 Koltisko
5,277,976 A 1/1994 Hogle et al.
5,294,482 A 3/1994 Gessner
5,336,552 A 8/1994 Strack et al.
5,352,518 A 10/1994 Muramoto et al.
5,374,696 A 12/1994 Rosen et al.
5,376,430 A 12/1994 Swenson et al.
5,382,400 A 1/1995 Pike et al.
5,411,636 A 5/1995 Hermans et al.
5,418,045 A 5/1995 Pike et al.
5,425,987 A 6/1995 Shawver et al.
5,429,856 A 7/1995 Krueger et al.
5,451,450 A 9/1995 Erderly et al.
5,456,982 A 10/1995 Hansen et al.
5,466,410 A 11/1995 Hills
5,470,639 A 11/1995 Gessner et al.
5,472,775 A 12/1995 Obijeski et al.
5,492,598 A 2/1996 Hermans et al.
5,498,468 A 3/1996 Blaney
5,501,679 A 3/1996 Krueger et al.
5,518,801 A 5/1996 Chappell et al.
H1558 H 7/1996 Goulait et al.
5,539,124 A 7/1996 Etherton et al.
5,540,992 A 7/1996 Marcher et al.
5,554,775 A 9/1996 Krishnamurti et al.
5,599,420 A 2/1997 Yeo et al.
5,604,036 A 2/1997 Price et al.
5,628,097 A 5/1997 Benson et al.
5,695,376 A 12/1997 Datta et al.
5,695,377 A 12/1997 Triebes et al.
5,707,468 A 1/1998 Arnold et al.
5,723,087 A 3/1998 Chappell et al.
5,723,546 A 3/1998 Sustic
5,743,999 A 4/1998 Kamps et al.
5,763,334 A 6/1998 Gupta et al.
5,783,503 A 7/1998 Gillespie et al.
5,814,567 A 9/1998 Yahiaoui et al.
5,853,635 A 12/1998 Morell et al.
5,910,136 A 6/1999 Hetzler et al.
5,945,175 A 8/1999 Yahiaoui et al.
5,972,502 A 10/1999 Jessee et al.
5,997,989 A 12/1999 Gessner et al.
6,017,832 A 1/2000 Yahiaoui et al.
6,028,016 A 2/2000 Yahiaoui et al.
6,054,002 A 4/2000 Griesbach, III et al.
6,140,442 A 10/2000 Knight et al.
6,169,045 B1 1/2001 Pike et al.
6,172,177 B1 1/2001 Wang et al.
6,194,532 B1 2/2001 Maugans et al.
6,203,654 B1 3/2001 McFall et al.
6,204,208 B1 3/2001 Krzysik et al.
6,214,274 B1 4/2001 Melius et al.
6,225,243 B1 5/2001 Austin
6,242,041 B1 6/2001 Katoot et al.
6,248,851 B1 6/2001 Maugans et al.
6,258,308 B1 7/2001 Brady et al.
6,264,864 B1 7/2001 Mackay
6,312,545 B1 11/2001 Nickel et al.
6,355,200 B1 3/2002 Schmidt et al.
6,383,431 B1 5/2002 Dobrin et al.
6,481,483 B1 11/2002 Kobayashi et al.
6,518,208 B1 * 2/2003 Terakawa ..... 264/103 X
6,541,403 B1 4/2003 Billarant et al.
2001/0041487 A1 11/2001 Brady et al.
2001/0042938 A1 11/2001 Mackay
2002/0088534 A1 7/2002 Kobayashi et al.
2002/0105110 A1 8/2002 Dobrin et al.
2002/0117770 A1 8/2002 Haynes et al.
2003/0050618 A1 3/2003 Kondo et al.

FOREIGN PATENT DOCUMENTS

EP 0 090 380 B1 12/1990
EP 0 276 100 B1 8/1994
EP 0 575 509 B1 10/1994
EP 0 379 763 B1 12/1994
EP 0 370 825 B1 12/1995
EP 0 747 521 A2 12/1996
EP 0 409 315 B1 5/1997
EP 0 573 586 B1 5/1997
EP 0 551 327 B1 6/1998
EP 0 696 655 B1 6/1998
EP 0 712 304 B1 4/1999
EP 0 782 639 B1 10/1999
EP 1 066 962 A2 1/2001
EP 0 777 008 B1 4/2001
EP 0 829 566 B1 8/2001
EP 1 151 846 A2 11/2001
EP 0 852 483 B1 4/2002
EP 0 927 096 B1 5/2002
GB 1 521 579 8/1978

| | | | |
|---|---|---|---|
| GB | 1 526 722 | | 9/1978 |
| GB | 1 526 723 | | 9/1978 |
| GB | 1 526 724 | | 9/1978 |
| GB | 1 553 102 | | 9/1979 |
| GB | 1 579 718 | | 11/1980 |
| GB | 1 598 737 | | 9/1981 |
| GB | 1 598 738 | | 9/1981 |
| JP | 62-078214 | A | 4/1987 |
| JP | 09-241961 | A | 9/1997 |
| JP | 11-158733 | A | 6/1999 |
| JP | 2002-69812 | A | 3/2002 |
| WO | WO 96/19346 | A2 | 6/1996 |
| WO | WO 97/49848 | A1 | 12/1997 |
| WO | WO 98/31318 | A1 | 7/1998 |
| WO | WO 99/42068 | A1 | 8/1999 |
| WO | WO 00/07821 | A1 | 2/2000 |
| WO | WO 00/23255 | A1 | 4/2000 |
| WO | WO 00/23509 | A1 | 4/2000 |
| WO | WO 00/28123 | A1 | 5/2000 |
| WO | WO 00/29199 | A1 | 5/2000 |
| WO | WO 00/29658 | A1 | 5/2000 |
| WO | WO 00/56522 | A1 | 9/2000 |
| WO | WO 00/69383 | A1 | 11/2000 |
| WO | WO 00/76445 | A1 | 12/2000 |
| WO | WO 00/76446 | A1 | 12/2000 |
| WO | WO 01/14627 | A1 | 3/2001 |
| WO | WO 02/102592 | A1 | 12/2002 |
| WO | WO 03/027364 | A1 | 4/2003 |
| WO | WO 03/027366 | A1 | 4/2003 |

* cited by examiner

METHOD OF FORMING A 3-DIMENSIONAL FIBER INTO A WEB

BACKGROUND OF THE INVENTION

There are numerous methods known to those skilled in the art for spinning fibers that can be later formed into a nonwoven web. Many such nonwoven webs are useful in disposable absorbent articles for absorbing body fluids and/or excrement, such as urine, fecal matter, menses, blood, perspiration, etc. Three dimensional fibers are also useful for machine direction and cross direction stretchable spunbond materials that can be made into bodyside covers, facings and liners. Manufacturers of such articles are always looking for new materials and ways to construct or use such new materials in their articles to make them more functional for the application they are designed to accomplish. The creation of a web of 3-dimensional, bicomponent fibers wherein the fibers are formed from at least one elastomeric material that can extend in at least one direction can be very beneficial. For example, an infant diaper containing an absorbent layer formed from cellulose pulp fibers interspersed into a web of 3-dimensional nonwoven fibers will allow the absorbent layer to retain a larger quantity of body fluid if the 3-dimensional fibers can extend. Such an absorbent layer can provide better leakage protection for the wearer and may not have to be changed as often. In another example, a spunbond nonwoven facing or liner formed from a plurality of 3-dimensional fibers can provide improved stretch and controllable retraction. Such facings or liners can provide improved fit and better comfort for the wearer of absorbent articles.

A web formed from such 3-dimensional fibers can provide one or more of the following attributes: improved fit, improved loft, better comfort, greater void volume, softer feel, improved resiliency, better stretch and controlled retraction.

The exact method utilized in forming a nonwoven web can create unique properties and characteristics in the web which can not be duplicated in another manner. Now, a new method of forming a web has been invented which allows the web to exhibit very desirable properties which are useful when the web is incorporated into a disposable absorbent article.

SUMMARY OF THE INVENTION

Briefly, this invention relates to a method of forming fibers into a web. The method includes the steps of co-extruding a first and a second component. The first component has a recovery percentage $R_1$ and the second component has a recovery percentage $R_2$, wherein $R_1$ is higher than $R_2$. The first and second components are directed through a spin pack to form a plurality of continuous molten, bicomponent fibers each having a predetermined diameter. The plurality of molten fibers is then routed through a quenching chamber to form a plurality of cooled fibers. The plurality of cooled fibers is then routed through a drawing unit to form a plurality of solid fibers each having a smaller diameter than the molten fibers. Each of the solid fibers is stretched by at least 50 percent and then is allowed to relax thereby forming a 3-dimensional fiber. The 3-dimensional fibers have a coiled configuration and are capable of expanding in at least one direction. The 3-dimensional fibers are then deposited onto a moving support, such as a forming wire, so as to form a web.

DETAILED DESCRIPTION OF THE INVENTION

Figure 1:
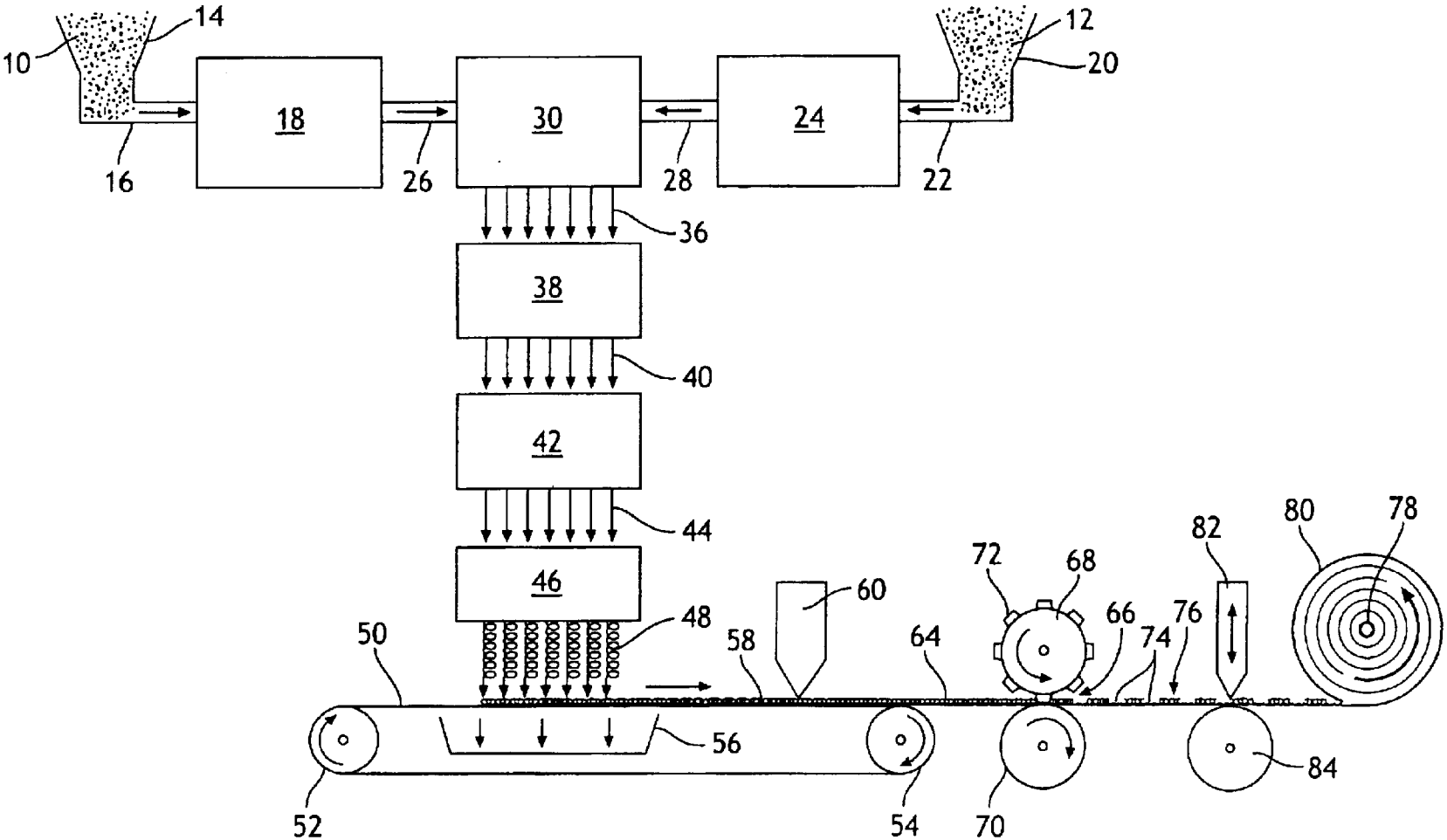
FIG. 1 is a schematic showing the equipment needed to practice the disclosed method of forming fibers into a web.

Referring to FIG. 1, a schematic of the equipment needed to practice the method of forming fibers into a web is depicted. The method includes the steps of co-extruding a first component 10 and a second component 12. The first and second components, 10 and 12 respectively, can be in the form of solid resin pellets or small particles. The first component 10 is positioned in a hopper 14 from which it can be metered and routed through a conduit 16 to a first extruder 18. Likewise, the second component 12 is positioned in a hopper 20 from which it can be metered and routed through a conduit 22 to a second extruder 24.

The first component 10 is a material that can be spun or otherwise formed into a continuous fiber. When the first component 10 is formed into a fiber, the fiber must be capable of being stretched and has a high recovery percentage $R_1$. The "recovery percentage $R_1$" is defined as the percent the first component 10 can recover after it has been stretched at least 50% of its initial length and upon removal of the force applied to stretch it. Desirably, the first component 10 is an elastomeric material. Suitable elastomeric materials that can be used for the first component 10 include a melt extrudable thermoplastic elastomer such as a polyurethane elastomer, a copolyether ester, a polyether block polyamide copolymer, an ethylene vinyl acetate (EVA) elastomer, a styrenic block copolymer, an ether amide block copolymer, an olefinic elastomer, as well as other elastomers known to those skilled in the polymer art. Useful elastomeric resins include polyester polyurethane and polyether polyurethane. Examples of two commercially available elastomeric resins are sold under the trade designations PN 3429-219 and PS 370-200 MORTHANE® polyurethanes. MORTHANE® is a registered trademark of Huntsman Polyurethanes having an office in Chicago, Ill. 60606. Another suitable elastomeric material is ESTANE®, a registered trademark of Noveon, Inc. having an office in Cleveland, Ohio 44141. Still another suitable elastomeric material is PEARLTHANE®, a registered trademark of Merquinsa having an office in Boxford, Mass. 01921.

Three additional elastomeric materials include a polyether block polyamide copolymer which is commercially available in various grades under the trade designation PEBAX®. PEBAX® is a registered trademark of Atofina Chemicals, Inc. having an office in Birdsboro, Pa. 19508. A second elastomeric material is a copolyether-ester sold under the trade designation ARNITEL®. ARNITEL® is a registered trademark of DSM having an office at Het Overloon 1, NL-6411 TE Heerlen, Netherlands. The third elastomeric material is a copolyether-ester sold under the trade designation HYTREL®. HYTREL® is a registered trademark of E. I. DuPont de Nemours having an office in Wilmington, Del. 19898.

The first component 10 can also be formed from a styrenic block copolymer such as KRATON®. KRATON® is a registered trademark of Kraton Polymers having an office in Houston, Tex.

The first component 10 can further be formed from a biodegradable elastomeric material such as polyester aliphatic polyurethanes or polyhydroxyalkanoates. The first component 10 can be formed from an olefinic elastomeric material, such as elastomers and plastomers. One such plastomer is an ethylene-based resin or polymer sold under the trade designation AFFINITY®. AFFINITY® is a registered trademark of Dow Chemical Company having an office in Freeport, Tex. AFFINITY® resin is an elastomeric copolymer of ethylene and octene produced using Dow Chemical Company's INSITE™ constrained geometry catalyst technology. Another plastomer is sold under the trade designation EXACT® which includes single site catalyzed derived copolymers and terpolymers. EXACT® is a registered trademark of Exxon Mobil Corporation having an office at 5959 Las Colinas Boulevard, Irving, Tex. 75039-2298. Other suitable olefinic elastomers that can be used to form the first component 10 include polypropylene-derived elastomers.

The first component 10 can further be formed from a non-elastomeric thermoplastic material which has a sufficient recovery percentage $R_1$ after it has been stretched at a specified temperature. Non-elastomeric materials useful in forming the first component 10 are extrudable thermoplastic polymers such as polyamides, nylons, polyesters, polyolefins or blends of polyolefins. For example, non-elastomeric, biodegradable polylactic acid can provide a sufficient recovery percentage $R_1$ when stretched above its glass transition temperature of about 62° C.

The second component 12, like the first component 10, is a material that can be spun or otherwise formed into a continuous fiber. When the second component 12 is formed into a linear fiber, the linear fiber must be capable of being stretched and has a recovery percentage $R_2$, wherein $R_1$ is higher than $R_2$. The "recovery percentage $R_2$" is defined as the percent the component can recover after it has been stretched at least 50% of its initial length and upon removal of the force applied to stretch it. When the first and second components, 10 and 12 respectively, are formed into a linear fiber, the fiber must be capable of retracting or contracting from a stretched condition in order for the linear fiber to be useful in an absorbent article. As referred to herein, the term "retracting" means the same thing as "contracting". Desirably, the ratio of $R_1/R_2$ ranges from at least about 2 to about 100. Most desirably, the ratio of $R_1/R_2$ ranges from at least about 2 to about 50. The reason for making $R_1$ greater than $R_2$ in a linear fiber is that upon retraction or contraction of the first and second components, 10 and 12 respectively, the 3-dimensional fiber will exhibit a very desirable, predetermined structural configuration. This structural configuration of the 3-dimensional fiber will display exceptional elongation properties in at least one direction.

The linear fiber further obtains some of its unique properties when the first component 10 makes up a volume percent of from about 30% to about 95% of the linear fiber and the second component 12 makes up a volume percent of from about 5% to about 70% of the linear fiber. Desirably, the first component 10 makes up a volume percent from about 40% to about 80% of the linear fiber and the second component 12 makes up a volume percent of from about 20% to about 60% of the linear fiber. The volume of a solid linear fiber is calculated using the following formula:

$$V=\pi(d^2/4)L_1$$

where: V is the volume of the solid linear fiber;

$\pi$ is a transcendental number, approximately 3.14159, representing the ratio of the circumference to the diameter of a circle and appearing as a constant in a wide range of mathematical problems;

d is the diameter of the linear fiber; and $L_1$ is the initial length of the linear fiber.

The above described ranges of volume percents for the first component 10 and for the second component 12 allow the linear fiber to be stretched at least 50% to form a stretched linear fiber. The volume percent of each of the first and second components, 10 and 12 respectively, also plays a vital role in the retraction or contraction of the stretched fiber to a retracted length. By varying the volume percent of each of the first and second components, 10 and 12 respectively, one can manufacture a linear fiber that can be stretched and then retracted to a predetermined configuration and with certain desirable characteristics. At a later time, after such fibers are formed into a disposable absorbent article, the contact with a body fluid will cause the absorbent article to swell which will allow the fibers to elongate in at least one direction before the fiber becomes linear. As the fibers elongate, they can extend and allow the absorbent structure to receive and store additional body fluids.

The first and second components, 10 and 12 respectively, are chemically, mechanically and/or physically adhered or joined to one another to prevent the fiber from splitting when the fiber is stretched and then allowed to relax. The relaxed fiber will retract in length. Desirably, the first component 10 will be strongly adhered to the second component 12. In the core/sheath arrangement, the mechanical adhesion between the first and second components, 10 and 12 respectively, will compliment any chemical and/or physical adhesion that is present and aid in preventing splitting or separation of the first component 10 from the second component 12. This splitting or separation occurs because one component is capable of retracting to a greater extent than the other component. If a strong mutual adhesion is not present, especially during retraction, the two components can split apart and this is not desirable. In a fiber formed of two components arranged in a side by side or wedge shape configuration, a strong chemical and/or physical adhesion will prevent the first component 10 from splitting or separating from the second component 12.

The second component 12 can be formed from polyolefins, such as polyethylene or polypropylene, a polyester or a polyether. The second component 12 can also be a polyolefin resin, such as a fiber grade polyethylene resin sold under the trade designation ASPUN® 6811A. ASPUN® is a registered trademark of Dow Chemical Company having an office in Midland, Mich. 48674. The second component 12 can also be a polyolefin resin, such as a homopolymer polypropylene such as Himont PF 304, and PF 308, available from Basell North America, Inc. having an office at Three Little Falls Centre, 2801 Centerville Road, Wilmington, Del. 19808. Another example of a polyolefin resin from which the second component 12 can be formed is polypropylene PP 3445 available from Exxon Mobil Corporation having an office at 5959 Las Colinas Boulevard, Irving, Tex. 75039-2298. Still other suitable polyolefinic materials that can be used for the second component 12 include random copolymers, such as a random copolymer containing propylene and ethylene. One such random copolymer is sold under the trade designation Exxon 9355, available from Exxon Mobil Corporation having an office at 5959 Las Colinas Boulevard, Irving, Tex. 75039-2298.

The second component 12 can also be formed from a melt extrudable thermoplastic material that provides sufficient permanent deformation upon stretching. Such materials include, but are not limited to, aliphatic and aromatic polyesters, copolyesters, polyethers, polyolefins such as polypropylene or polyethylene, blends or copolymers thereof, polyamides and nylons. The second component 12 can further be formed from biodegradable resins, such as aliphatic polyesters. One such aliphatic polyester is polylactic acid (PLA). Other biodegradable resins include polycaprolactone, polybutylene succinate adipate and polybutylene succinate. Polybutylene succinate adipate and polybutylene succinate resins are sold under the trade designation BIONOLLE® which is a registered trademark of Showa High Polymers having a sales office in New York, N.Y. 10017. Additional biodegradable resins include copolyester resin sold under the trade designation EASTAR BIO®. EASTAR BIO® is a registered trademark of Eastman Chemical Company having an office in Kingsport, Tenn. 37662. Still other biodegradable resins that can be used for the second component 12 include polyhydroxyalkanoates (PHA) of varying composition and structure, and copolymers, blends and mixtures of the foregoing polymers. Specific examples of suitable biodegradable polymer resins include BIONOLLE® 1003, 1020, 3020 and 3001 resins commercially available from Itochu International. BIONOLLE® is a registered trademark of Showa High Polymers having an office in New York, N.Y. 10017.

The second component 12 can also be formed from a water-soluble and swellable resin. Examples of such water-soluble and swellable resins include polyethylene oxide (PEO) and polyvinyl alcohol (PVOH). Grafted polyethylene oxide (gPEO) or chemically modified PEO can also be used. The water-soluble polymer can be blended with a biodegradable polymer to provide for better processing, performance, and interactions with liquids.

It should be noted that the PEO resin can be chemically modified by reactive extrusion, grafting, block polymerization or branching to improve its processability. The PEO resin can be modified by reactive extrusion or grafting as described in U.S. Pat. No. 6,172,177 issued to Wang et al. on Jan. 9, 2001.

Lastly, the second component 12 has a lower recovery percentage $R_2$ than the first component 10. The second component 12 can be formed from a material that exhibits a low elastic recovery. Materials from which the second component 12 can be formed include, but are not limited to polyolefin resins, polypropylene, polyethylene, polyethylene oxide (PEO), polyvinyl alcohol (PVOH), polyester and polyether. The second component 12 can be treated or modified with hydrophilic or hydrophobic surfactants. Treatment of the second component 12 with a hydrophilic surfactant will form a wettable surface for increasing interaction with a body fluid or liquid. For example, when the surface of the second component 12 is treated to be hydrophilic, it will become more wettable when contacted by a body fluid, especially urine. Treatment of the second component 12 with a hydrophobic surfactant will cause it to repel a body fluid or liquid. Similar treatment of the first component 10 can also be done to control its hydrophilic or hydrophobic characteristics.

Referring again to FIG. 1, the first and second components, 10 and 12 respectively, are separately co-extruded in the two extruders 18 and 24. The extruders 18 and 24 function in a manner that is well known to those skilled in the extrusion art. In short, the solid resin pellets or small particles are heated up above their melting temperature and advanced along a path by a rotating auger. The first component 10 is routed through a conduit 26 while the second component 12 is simultaneously routed through a conduit 28 and both flow streams are directed into a spin pack 30. A melt pump, not shown, can be positioned across one or both of the conduits 26 and 28 to regulate volumetric distribution, if needed. The spin pack 30 is a device for making synthetic fibers. The spin pack 30 includes a bottom plate having a plurality of holes or openings through which the extruded material flows. The number of openings per square inch in the spin pack 30 can range from about 5 to about 500 openings per square inch. Desirably, the number of openings per square inch in the spin pack 30 is from about 25 to about 250. More desirably, the number of openings per square inch in the spin pack 30 is from about 125 to about 225. The size of each of the openings in the spin pack 30 can vary. A typical size opening can range from about 0.1 millimeter (mm) to about 2.0 mm in diameter. Desirably, the size of each of the openings in the spin pack 30 can range from about 0.3 mm to about 1.0 mm in diameter. More desirably, the size of each of the openings in the spin pack 30 can range from about 0.4 mm to about 0.8 mm in diameter.

It should be noted that the openings in the spin pack 30 do not have to be round or circular in cross-section but can have a bilobal, trilobal, square, triangular, rectangular, oval or any other geometrical cross-sectional configuration that is desired.

Figure 2:
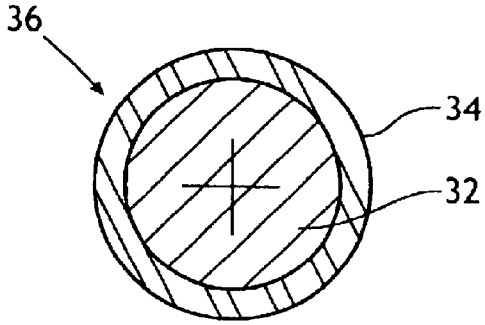
FIG. 2 is a cross-section of a bicomponent fiber.

Referring to FIGS. 1 and 2, the first and second components, 10 and 12 respectively, are directed into the spin pack 30 and are routed through the openings formed in the bottom plate in such a fashion that the first component 10 will form a core 32 while the second component 12 will form a sheath 34 which surrounds the outside circumference of the core 32. It should be noted that the first component 10 could form the sheath while the second component 12 could form the core, if desired. This core/sheath arrangement produces one configuration of a linear, bicomponent fiber 36. Bicomponent fibers having other cross-sectional configurations can also be produced using the spin pack 30. For example, the bicomponent fiber can have a side by side configuration or a core/sheath design where the core is offset coaxially from the sheath.

One bicomponent fiber 36 will be formed for each opening formed in the plate within the spin pack 30. This enables a plurality of continuous molten fibers 36, each having a predetermined diameter, to simultaneously exit the spin pack 30 at a first speed. Each linear, bicomponent fiber 36 will be spaced apart and be separated from the adjacent fibers 36. The diameter of each bicomponent fiber 36 will be dictated by the size of the openings formed in the bottom plate of the spin pack 30. For example, as stated above, if the diameter of the holes or openings in the bottom plate range from about 0.1 mm to about 2.0 mm, then each of the molten fibers 36 can have a diameter which ranges from about 0.1 mm to about 2.0 mm. There is a tendency for the molten fibers 36 to sometimes swell in cross-sectional area once they exit the opening formed in the plate but this expansion is relatively small.

The plurality of continuous molten fibers 36 are routed through a quench chamber 38 to form a plurality of cooled linear, bicomponent fibers 40. Desirably, the molten fibers 36 are directed downward from the spin pack 30 into the quench chamber 38. The reason for directing the molten fibers 36 downward is that gravity can be used to assist in moving the molten fibers 36. In addition, the vertical downward movement can aid in keeping the fibers 36 separated from one another.

In the quench chamber 38, the continuous molten fibers 36 are contacted by one or more streams of air. Normally, the temperature of the continuous molten fibers 36 exiting the spin pack 30 and entering the quench chamber 38 will be in the range of from about 150° C. to about 250° C. The actual temperature of the molten fibers 36 will depend on the material from which they are constructed, the melting temperature of such material, the amount of heat applied during the extrusion process, as well as other factors. Within the quench chamber 38, the continuous molten fibers 36 are contacted and surrounded by lower temperature air. The temperature of the air can range from about 0° C. to about 120° C. Desirably, the air is cooled or chilled so as to quickly cool the molten fibers 36. However, for certain materials used to form the bicomponent fibers 36; it is advantageous to use ambient air or even heated air. However, for most elastomeric materials, the air is cooled or chilled to a temperature of from about 0° C. to about 40° C. More desirably, the air is cooled or chilled to a temperature of from about 15° C. to about 30° C. The lower temperature air can be directed toward the molten fibers 36 at various angles but a horizontal or downward angle seems to work best. The velocity of the incoming air can be maintained or adjusted so as to efficiently cool the molten fibers 36.

The cooled or chilled air will cause the continuous molten fibers 36 to crystallize, assume a crystalline structure or phase separate and form a plurality of continuous cooled fibers 40. The cooled fibers 40 are still linear in configuration at this time. Upon exiting the quench chamber 38, the temperature of the cooled fibers 40 can range from about 15° C. to about 100° C. Desirably, the temperature of the cooled fibers 40 will range from about 20° C. to about 80° C. Most desirably, the temperature of the cooled fibers 40 will range from about 25° C. to about 60° C. The cooled fibers 40 will be at a temperature below the melting temperature of the first and second components, 10 and 12 respectively, from which the fibers 40 were formed. The cooled fibers 40 may have a soft plastic consistency at this stage.

The plurality of continuous cooled fibers 40 are then routed to a draw unit 42. The draw unit 42 can be vertically located below the quenching chamber 38 so as to take advantage of gravity. The draw unit 42 should have sufficient height to provide an adequate distance over which the cooled fibers 40 can be drawn. Drawing involves subjecting the cooled fibers 40 to pressurized air that will pull or draw the molten material exiting the spin pack 30 downward. The air pressure can range from about 3 pounds per square inch (psi) to about 100 psi. Desirably, the air pressure can range from about 4 psi to about 50 psi. More desirably, the air pressure can range from about 5 psi to about 20 psi. As in the quench chamber 38, the velocity of the pressurized air can be maintained or adjusted so as to efficiently draw the cooled fibers 40.

The pressurized air can be at ambient temperature of about 25° C. or the pressurized air can be either hotter or colder depending upon one's preference. The cooled fibers 40 are drawn down mainly from the molten state and not from the cooled state. The downward force of the pressurized air in the draw unit 42 will cause the molten material to be lengthened and elongated into solid fibers 44. Lengthening of the molten material will usually shape, narrow, distort, or otherwise change the cross-sectional area of the solid fibers 44. For example, if the molten material has a round or circular cross-sectional area upon exiting the spin pack 30, the outside diameter of the solid fibers 44 will be reduced. The amount that the diameter of the solid linear fibers 44 are reduced will depend upon several factors, including the amount the molten material is drawn, the distance over which the fibers are drawn, the pressure and temperature of the air used to draw the fibers, the spin line tension, etc. Desirably, the diameter of the solid linear fibers 44 will range from about 5 microns to about 100 microns. More desirably, the diameter of the solid linear fibers 44 will range from about 10 microns to about 50 microns. Most desirably, the diameter of the solid linear fibers 44 will range from about 10 microns to about 30 microns.

Within the draw unit 42, the cooled fibers 40 will be pulled at a second speed that is faster than the first speed displayed by the continuous molten fibers 36 exiting the spin pack 30. This change in speed between the continuous molten fibers 36 and the continuous cooled fibers 40 enables the molten material to be lengthened and also to be reduced in cross-sectional area. Upon exiting the draw unit 42, the cooled fibers 40 will be solid fibers 44.

Each of the plurality of solid fibers 44 exiting the draw unit 42 are then routed to a stretching unit 46 where each is stretched by at least 50%. By "stretched" it is meant that the continuous solid, linear fibers 44 are lengthened or elongated while in the cooled and/or solid states. The stretching is caused by axial tension exerted on both the cooled fibers 40 and on the solid fibers 44. Desirably, the stretching causes a downward force to be applied against the continuous solid fibers 44. Because the molten state, cooled state and solid state are axially aligned, any tension exerted on the lower solid fibers 44 will be transmitted upward through the cooled fibers 40 and still upward into the molten fibers 36. The exact location where the stretching will occur will be dependent upon the equipment utilized, the composition of the first and second components, 10 and 12 respectively, operating conditions, etc. As the cooled fibers 40 and the solid fibers 44 are stretched, the cross-sectional area of the fibers 40 and 44 will be reduced. Desirably, the amount of stretch imparted into the cooled and solid fibers, 40 and 44 respectively, can range from about 75% to about 1,000%. More desirably, the amount of stretch imparted into the cooled and solid fibers, 40 and 44 respectively, can range from about 100% to about 500%. Most desirably, amount of stretch imparted into the cooled and solid fibers, 40 and 44 respectively, can range from about 150% to about 300%.

It should be noted that the fibers 44 can be stretched without splitting and without forming split fibers. The first and second components, 10 and 12 respectively, of the fibers 44 are chemically, mechanically and/or physically adhered or joined together to prevent splitting.

The stretching will cause the cross-sectional area of each of the bicomponent fibers 40 and 44 to be reduced from about 5% to about 90% from the cross-sectional area of the cooled fibers 40. Desirably, the cross-sectional area of the bicomponent fibers 40 and 44 are reduced from about 10% to about 60% from the cross-sectional area of the cooled fibers 40. More desirably, the cross-sectional area of the bicomponent fibers 40 and 44 are reduced from about 20% to about 50% from the cross-sectional area of the cooled fibers 40. The stretched, bicomponent continuous fibers 40 and 44 will be relatively small in diameter or cross-sectional area. Desirably, the diameter of the stretched, continuous fibers 40 and 44 will range from about 5 microns to about 50 microns. More desirably, the diameter of the stretched fibers 40 and 44 will range from about 5 microns to about 30 microns. Most desirably, the diameter of the stretched fibers 40 and 44 will range from about 10 microns to about 20 microns.

The stretching unit 46 can use pressurized air to stretch the fibers 40 and/or 44. Alternatively, the stretching unit 46 can use a mechanical apparatus to impart a pull on each of the fibers 40 and/or 44 in order to stretch them. Desirably, pressurized air is used in a similar fashion as was used in the draw unit 42. The air is pressurized to a predetermined value and then is directed at a desired velocity into the stretching unit 46 at a horizontal or downward angle so as to stretch the plurality of solid linear fibers 44. When pressurized air is used, the air pressure can range from about 3 pounds per square inch (psi) to about 100 psi. Desirably, the air pressure can range from about 4 psi to about 50 psi. More desirably, the air pressure can range from about 5 psi to about 20 psi. The pressurized air can be heated to soften the fibers 40 and/or 44 and thereby facilitate stretching.

Alternatively, the stretching unit 46 can be combined into the draw unit 42, if desired. When the two units 42 and 46 are combined, the stretching step should occur in a lower portion of the draw unit 42 after the fibers 40 and/or 44 are formed. The reason for this is that the fibers 40 and/or 44 should have a definite and permanent configuration before being stretched so that the stretched fibers exhibit the ability to retract or contract once the stretching force is removed. By "retract" it is meant the ability to be shortened, take back, draw back or recover to an earlier state. The two words "retract" and "contract" are used interchangeably herein to describe this invention. When the stretching step is combined into the draw unit 42, the air pressure and/or velocity of the air used to stretch the fibers 40 and/or 44 can be the same or higher than the air pressure and/or velocity used to draw the cooled fibers 40.

Figure 3:
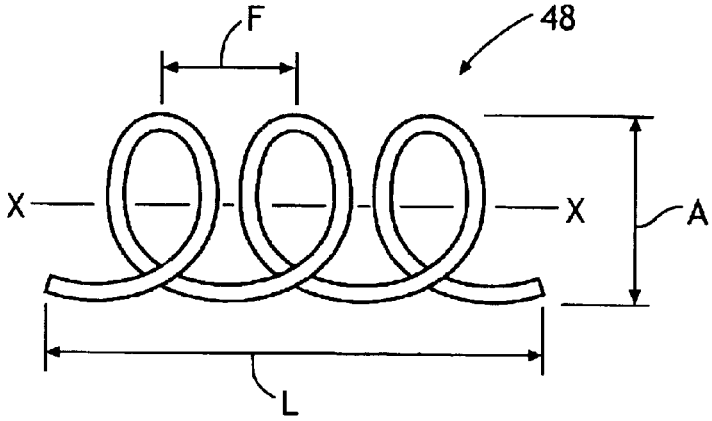
FIG. 3 is a side view of a helical fiber formed when the force used to stretch the solid fiber is removed and the fiber is allowed to relax.

Referring to FIGS. 1 and 3, one will notice that upon exiting the stretching unit 46, the force used to stretch the fibers 40 and/or 44 is removed and the solid linear fibers 44 are allowed to relax. This relaxation enables the linear fibers 44 to retract or contract into a plurality of continuous 3-dimensional, bicomponent fibers 48. In FIG. 3, a portion of a continuous 3-dimensional, bicomponent fiber 48 is depicted in the shape of a helix or helical coil that has a longitudinal central axis x—x. By "3-dimensional fiber" is meant a fiber having an x, y and z component that is formed by virtue of coils and/or curves regularly or irregularly spaced and whose extremities in the x, y and z planes form a locus of points which define a volume greater than a linear fiber. The continuous 3-dimensional fibers 48 will have a generally helical configuration. The helical configuration can extend along the entire length L of each of the continuous 3-dimensional fibers 48 or it can occur over a portion of the continuous length of the 3-dimensional fibers 48. Desirably, the coiled configuration extends over at least half of the length of each of the continuous 3-dimensional fibers 48. More desirably, the coiled configuration extends from about 50% to about 90% of the length of each of the continuous 3-dimensional fibers 48. Most desirably, the coiled configuration extends from about 90% to about 100% of the length of each of the continuous 3-dimensional fibers 48. It should be noted that the coils can be formed in the clockwise or counterclockwise directions along at least a potion of the length of the continuous 3-dimensional fibers 48. It should also be noted that the configuration of each coil can vary along the length of each of the continuous 3-dimensional fibers 48.

Each of the continuous 3-dimensional fibers 48 can form a coil fiber having coils that circumscribes 360 degrees. The helical coils can be continuous or non-continuous over either a portion of or over the entire length of the continuous 3-dimensional fiber 48. Most desirably, the continuous 3-dimensional fibers 48 exhibit a continuous helical coil. The continuous 3-dimensional fiber 48 differs from a 2-dimensional fiber in that a 2-dimensional fiber has only two components, for example, an "x" and a "y" component; an "x" and a "z" component, or a "y" and a "z" component. The continuous 3-dimensional fiber 48 has three components, an "x" component, a "y" component and a "z" component. Many crimp fibers are 2-dimensional fibers that are flat and extend in only two directions. A crimped fiber is typically a fiber that has been pressed or pinched into small, regular folds or ridges. A crimped fiber usually has a bend along its length.

The continuous 3-dimensional fiber 48 has a non-linear configuration when it forms a helical coil. The continuous 3-dimensional fiber 48 also has an amplitude "A" that is measured perpendicular to a portion of its length L. The amplitude "A" of the continuous 3-dimensional fiber 48 can range from about 10 microns to about 5,000 microns. Desirably, the amplitude "A" of the continuous 3-dimensional fiber 48 ranges from about 30 microns to about 1,000 microns. Most desirably, the amplitude "A" of the continuous 3-dimensional fiber 48 ranges from about 50 microns to about 500 microns. The continuous 3-dimensional fiber 48 further has a frequency "F" measured at two locations separated by 360 degrees between adjacent helical coils. The frequency "F" is used to denote the number of coils or curls formed in each inch of the coiled fiber length. The frequency "F" can range from about 10 to about 1,000 coils per inch. Desirably, the frequency "F" can range from about 50 to about 500 coils per inch. It should be noted that the amplitude "A" and/or the frequency "F" can vary or remain constant along at least a portion of the length L, or over the entire length, of the continuous3-dimensional fiber 48. Desirably, the amplitude "A" and the frequency "F" will remain constant over a majority of the length L. The amplitude "A" of the continuous 3-dimensional fiber 48 and the frequency "F" of the helical coils forming the continuous 3-dimensional fiber 48 affect the overall reduction in the length of the continuous 3-dimensional fiber 48 from it's stretched condition.

It should be noted that the deformation properties of the first and second components, 10 and 12 respectively, will affect the configuration and size of the helical coils developed as the stretched fibers retracts into the continuous 3-dimensional fiber 48.

The first and second components, 10 and 12 respectively, are adhered together in the spin pack 30 to form a continuous bicomponent fiber. The first component 10 in the solid linear fiber 44 has an elongation of at least about 50% deformation. The first component 10 is able to recover at least about 20% of the stretch deformation imparted thereto, based on its length after deformation. Desirably, the first component 10 in the solid linear fiber 44 is able to recover at least about 50% of its stretch deformation. If the first component 10 has an elongation below at least about 50%, the recovery or relaxation power may not be sufficient to activate helical coiling of the 3-dimensional fiber 48. Repetitive helical coils in the retracted 3-dimensional fiber 48 are most desirable. A higher elongation than at least about 50% for the first component 10 is desirable. For example, an elongation of at least about 100% is good, an elongation exceeding 300% is better, and an elongation exceeding 400% is even better.

The second component 12 in the solid linear fiber 44 has a total deformation which includes a permanent unrecoverable deformation value and a recoverable deformation value. The permanent unrecoverable deformation value in a solid state, as a result of stretching, plastic yielding and/or drawing, is at least about 40%. The recoverable deformation value is at least about 0.1%. A higher deformation than at least about 50% for the second component 12 is desirable. A deformation of at least about 100% is good and a deformation exceeding about 300% is even better. The plastic yielding and drawing results in thinning of a second component 12. The second component 12 has a deformation which can range from about 50% to about 700% or more when the linear fiber 44 is stretched in a solid state. Stretching in a solid state means that the second component 12 is stretched below its melting temperature. If the total deformation of the second component 12 is below at least about 50%, the second component 12 will fail and break during the stretching process. Also, at low deformation, the second component 12 does not provide a sufficient level of permanent plastic yielding and thinning which is desired for the formation of the repetitive helical coils in the 3-dimensional fiber 48. Stretching should not occur at very low temperatures because the fibers may be brittle and could break. Likewise, the fibers should not be stretched very quickly because this might cause the fibers to break before reaching the desired percent of elongation.

The percent elongation of the length of the continuous, 3-dimensional coiled fiber 48 is defined as the percent change in length by which the continuous, 3-dimensional coiled fiber 48 can be stretched before becoming straight or linear. The percent elongation can be expressed by the following formula:

$$\% E = 100 \times (L_1 - L)/L$$

where: % E is the percent elongation of the 3-dimensional fiber 48;

L is the retracted length of the 3-dimensional fiber 48; and $L_1$ is the final length of the 3-dimensional fiber 48 once it is stretched into a straight or uncoiled configuration.

The retracted 3-dimensional fiber 48 has the ability to be subsequently elongated to at least 100% of its retracted length. Most desirably, the retracted 3-dimensional fiber 48 can be subsequently elongated from about 150% to about 900% of its retracted length. Even more desirably, the retracted 3-dimensional fiber 48 can be subsequently elongated from about 250% to about 500% of its retracted length. Still more desirably, the retracted 3-dimensional fiber 48 can be subsequently elongated from about 300% to about 400% of its retracted length.

The continuous 3-dimensional fiber 48 exhibits exceptional elongation properties in at least one direction before the fiber becomes linear. Elongation is defined as the percent length by which the 3-dimensional fiber 48 can be stretched before it becomes straight or linear. The direction of the elongation property of the 3-dimensional fiber 48 is normally in the same direction as the linear fiber 44 was stretched. In other words, the direction that the retracted fiber 48 is able to subsequently elongate will be opposite to the direction of its retraction. It is possible for the retracted fiber 48 to have elongation properties in two or more directions. For example, the retracted fiber 48 can subsequently be elongated in both the x and y directions.

The continuous 3-dimensional fiber 48 is obtained once the stretched fiber 44 is allowed to relax or retract. The continuous 3-dimensional fiber 48 is able to acquire its helical profile by the difference in recovery percentage $R_1$ of the first component 10 compared to the recovery percentage $R_2$ of the second component 12. For example, since the first component 10 has a higher recovery percentage $R_1$ than the recovery percentage $R_2$ of the second component 12, the first component 10 will want to retract to a greater degree than the second component 12. However, both the first and second components, 10 and 12 respectively, will retract or contract the same amount since they are physically, chemically or mechanically adhered or joined to one another. The combination of the volume percent and the recovery percent of the first and second components, 10 and 12 respectively, creates the unique 3-dimensional configuration of the fiber 48. The retraction or recovery of the first and second components, 10 and 12 respectively, establishes the twist or coiling effect in the retracted fiber 48. The amount of coiling obtained, as well as the shape and location of the coiling, can be controlled by the selection of materials that are used to construct the linear fiber 44. These three variables, the amount of coiling, the shape and the location of the coiling, can also be controlled by the volume of each component, as well as the amount the linear fiber 44 is stretched. The time and temperature conditions under which the solid fibers 44 are stretched and allowed to retract can also affect the finish profile of the retracted fiber 48.

The first component 10 has a higher recovery percentage $R_1$ than the recovery percentage $R_2$ of the second component 12 and therefore the material from which the first component 10 is formed tends to be more tacky and elastic. For this reason, the material with the higher recovery percentage $R_1$ is used to form the inner core while the material having a lower recovery percentage $R_2$ tends to be used to form the outer sheath. As the first and second components, 10 and 12 respectively, try to retract from the stretched condition; the outer sheath will retract or contract less. This means that the first component 10 will not be able to retract fully to an amount that it could if it was by itself. This pent up force creates the twist or helical coil effect in the retracted fiber 48. By varying the materials used to form the linear fiber 44 and by controlling the conditions to which the linear fiber 44 is stretched and then retracted, one can manufacture uniquely configured 3-dimensional fibers that will subsequently elongate in a predetermined way. This characteristic has been identified as being extremely useful in constructing disposable absorbent articles. This characteristic may also exhibit beneficial features in other articles as well.

The following Table 1 shows the recovery percent of individual materials that have been stretched to varying percentages. The material forming each sample was cut out from a thin sheet of a particular thickness in the shape of a dogbone or dumbbell. The dogbone shaped sample had an initial length of 63 millimeters (mm) measured from a first enlarged end to a second enlarged end. In between the two oppositely aligned, enlarged ends was a narrow section having a length of 18 mm and a width of 3 mm. The material was then placed in a tensile tester and stretched at a rate of 5 inches per minute, in the machine direction of the material. This stretching caused the narrow section of the sample to elongate. The force used to stretch the sample was then removed and the sample was allowed to retract or recover. The retracted length of the narrow section, known as the finished recovery length, was measured and recorded as a percentage of the stretched length. One can extrapolate from this information that when such a material is combined with another material to form a linear fiber 44, that similar ranges of recovery or contraction can be experienced.

TABLE 1

| Material | Thickness in mils | Stretch Temp. C.° | 50% stretched & recovered | 100% stretched & recovered | 200% stretched & recovered | 700% stretched & recovered |
|---|---|---|---|---|---|---|
| Polyurethane | 5 | 25 | 24.5% | 39.1% | 54.4% | — |
| Polypropylene | 3 | 25 | 5.4% | 5.5% | 5.1% | — |
| Polypropylene | 3 | 75 | — | 8.7% | 7.3% | 6.4% |

In Table 1, the dogbone shaped sample had a narrow section $I_1$ located between its first and second enlarged ends. Each of the enlarged ends of the dog bone sample was secured in a tensile tester and a force was applied causing the material to be stretched, in the machine direction of the material, a predetermined amount at a specific temperature. By stretching the sample, the narrow section is stretched to a length $I_2$. The length $I_2$ is greater than the initial length $I_1$. The force exerted on the sample was then removed and the sample was allowed to retract such that the narrow section is shortened to a length $I_3$. The retracted length $I_3$ is smaller than the stretched length $I_2$ but is greater than the initial length $I_1$. The recovery percent (R %) of the different materials that can be used in forming the fiber can be calculated using the following formula:

$$\text{Recovery } \% = [(I_2 - I_3)/I_2] \times 100$$

where: $I_2$ is the stretched length of the narrow section of the sample; and $I_3$ is the retracted length of the narrow section of the sample.

Returning to FIG. 1, the 3-dimensional, coiled fibers 48 are deposited onto a moving support or forming surface 50. The moving support 50 can be a continuous forming wire or belt that is driven by a drive roll 52 while revolving about a guide roll 54. One or more guide rolls can be utilized if needed. Other types of moving supports known to those skilled in the art can also be utilized. The moving support 50 can be constructed as a fine, medium or coarse mesh having either no openings or a plurality of openings formed therein. For example, the moving support 50 can have a configuration similar to a standard window screen or it can be tightly woven to resemble a wire or felt used by the paper industry in the formation of paper. A vacuum chamber 56 can optionally be positioned below the moving support 50 to facilitate accumulation of the 3-dimensional fibers 48 onto the moving support 50.

Figure 4:
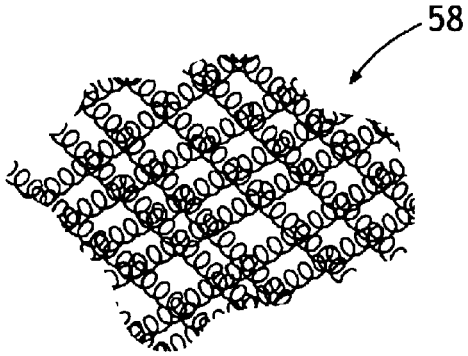
FIG. 4 is a top view of a portion of a web formed from a plurality of 3-dimensional fibers that have accumulated on a moving support.
Figure 5:
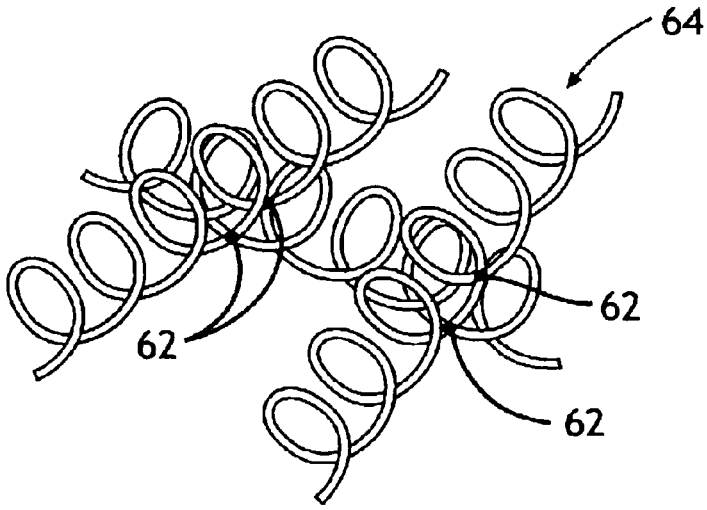
FIG. 5 is a top view of a portion of the web shown in FIG. 4 after the fibers have been subjected to jets of hot air to form a stabilized web.

Referring now to FIGS. 4 and 5, as the plurality of continuous 3-dimensional fibers 48 accumulate on the moving support 50, a random orientation occurs and forms a web 58. The web 58 is merely an accumulation of continuous, 3-dimensional coiled fibers 48 at this point and does not contain any melt points or bonds which help to stabilize the web 58. The thickness and basis weight of the web 58 will be dictated by the speed of the moving support 50, the number and diameter of the continuous, 3-dimensional coiled fibers 48 deposited onto the moving support 50, as well as the speed that the 3-dimensional fibers 48 are being deposited onto the moving support 50. The nonwoven web 58 is then routed under a hot air knife 60 that directs one or more jets or streams of hot air against the web 58. By "hot air" is meant air that it has been heated to a predetermined elevated temperature. The exact temperature used will be determined based on the material used to form the bicomponent 3-dimensional fibers 48. The hot air should be of a sufficient temperature to melt some of the fibers 48 at points where such fibers 48 contact, intersect or overlap adjacent fibers 48. The hot air causes some of the fibers 48 to melt and adhere to adjacent fibers 48 at a plurality of melt points 62. The melt points are bonds formed at the intersection of two or more continuous fibers 48. The number of melt points 62 formed can vary and will be determined by a number of factors: including the speed of the web 58, the temperature of the hot air, the composition of the bicomponent fibers 48, the degree to which the continuous 3-dimensional fibers 48 are entangled, the basis weight of the web, etc. For example, one could form from about 10 to about 10,000 melt points per square inch. The continuous 3-dimensional fibers 48 adhered by the plurality of melt points 62 form a stabilized web 64. Alternatively, compaction rolls can also be used to form a stabilized web 64.

Figure 6:
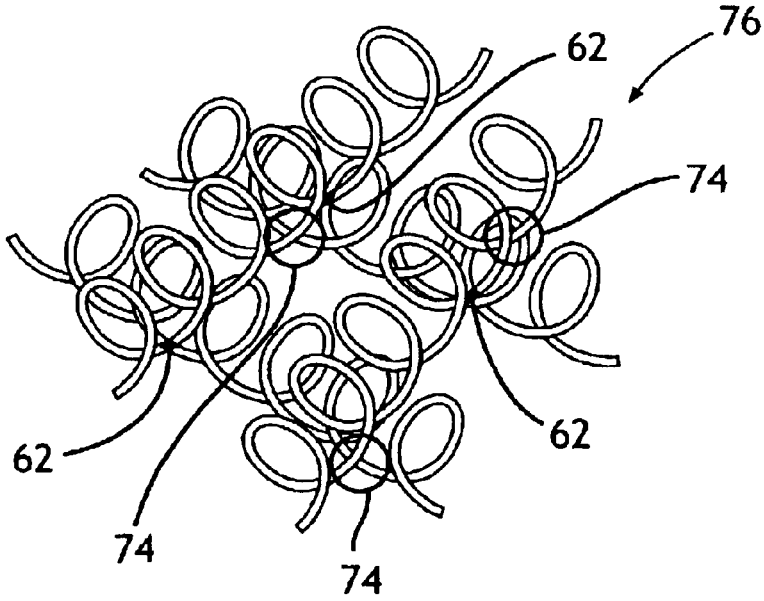
FIG. 6 is a top view of a portion of the web shown in FIG. 5 after the fibers have been bonded to form a bonded web.

Referring now to FIGS. 1 and 6, the stabilized web 64 is routed through a nip 66 formed by a bond roll 68 and a anvil roll 70. The bond roll 68 and the anvil roll 70 are typically heated to an elevated temperature. The bond roll 68 contains one or more outwardly projecting nubs or protuberances 72. The nubs or protuberances 72 extend outward from the outer circumference of the bond roll 68 and are sized and shaped to create a plurality of bonds 74 in the stabilized web 64. Once the stabilized web 64 has the bonds 74 formed therein, it becomes a bonded web 76. The bond roll 68 and the anvil roll 70 can be rotated as the stabilized web 64 passes through the nip 66. The nubs or protuberances 72 will penetrate a predetermined depth into the stabilized web 64 and form the bonds 74. The bonded web 76 can be a spunbond nonwoven web. Spunbond is a nonwoven material made by extruding molten thermoplastics into fibers having a relatively small diameter. The exact number and location of the bonds 74 in the bonded web 76 will be dictated by the position and configuration of the nubs or protuberances 72 formed on the outer circumference of the bond roll 68. Desirably, at least one bond 74 per square inch is formed in the bonded web 76. More desirably, from about 20 to about 500 bonds 74 per square inch are formed in the bonded web 76. Most desirably, at least about 30 bonds 74 per square inch are formed in the bonded web 76. Typically, the percent bonded area varies from about 10% to about 30% of the total area of the web 76.

The bonded web 76 can have an elongation of up to about 400% in at least one direction, the machine direction, the cross direction or it can have an elongation in both directions. Desirably, the bonded web 76 has an elongation of up to about 200% in the machine direction, the cross direction or in both directions. More desirably, the bonded web 76 has an elongation of up to about 100% in the machine direction, the cross direction or in both directions. The bonded web 76 can be elongated and then has the ability to retract to approximately its original length when the elongation force is removed.

Returning again to FIG. 1, the bonded web 76 can then be routed to a take up roll 78 where it can accumulate into a large supply roll 80. When the supply roll 80 reaches a desired outside diameter, the bonded web 76 can be cut using a cutting knife 82 and a cooperating anvil 84. Other means for cutting or severing the bonded web 76 at a desired time can also be utilized. Such cutting means are well known to those skilled in the art.

Figure 7:
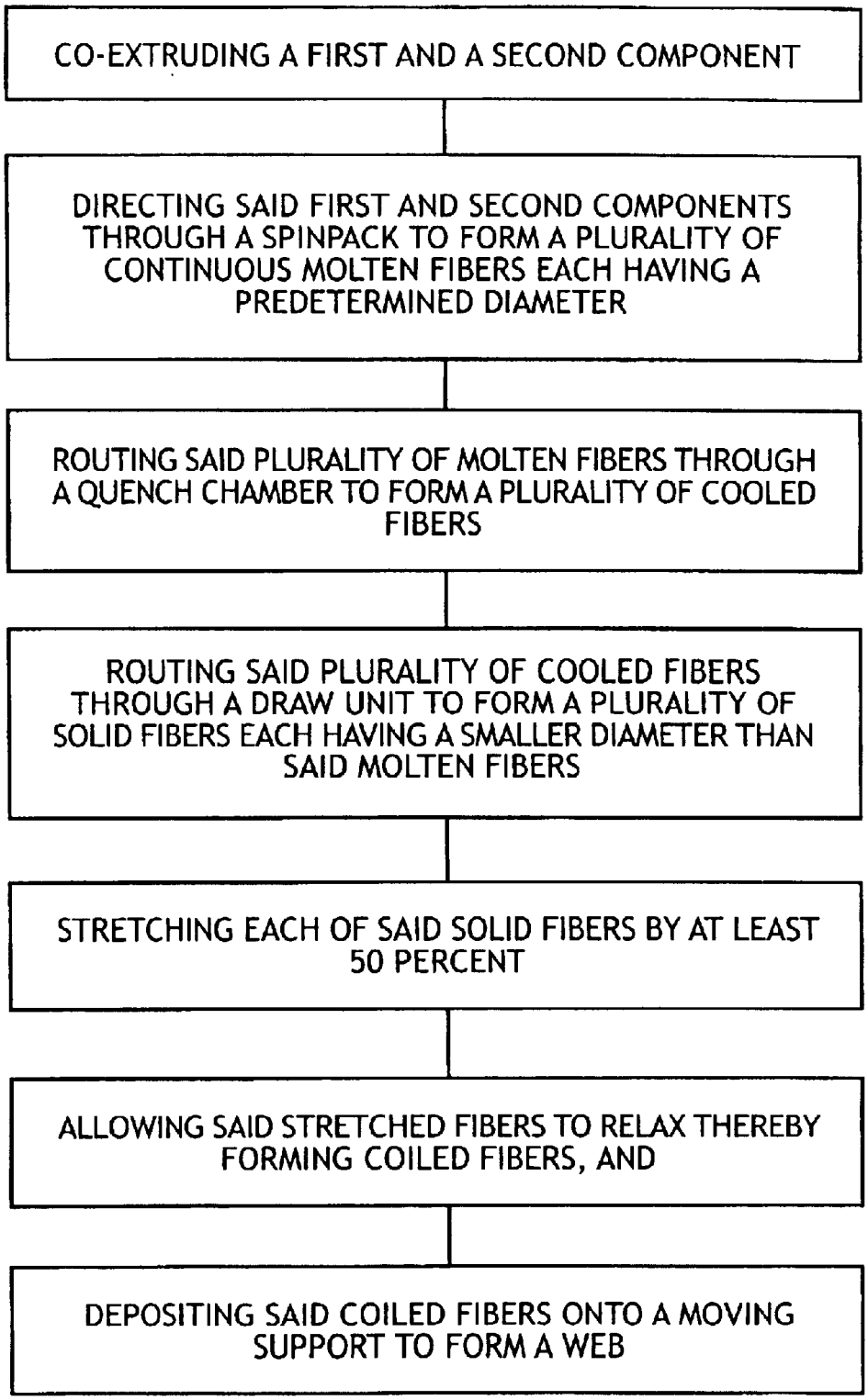
FIG. 7 is a flow diagram of a method of forming fibers into a web.
Figure 8:
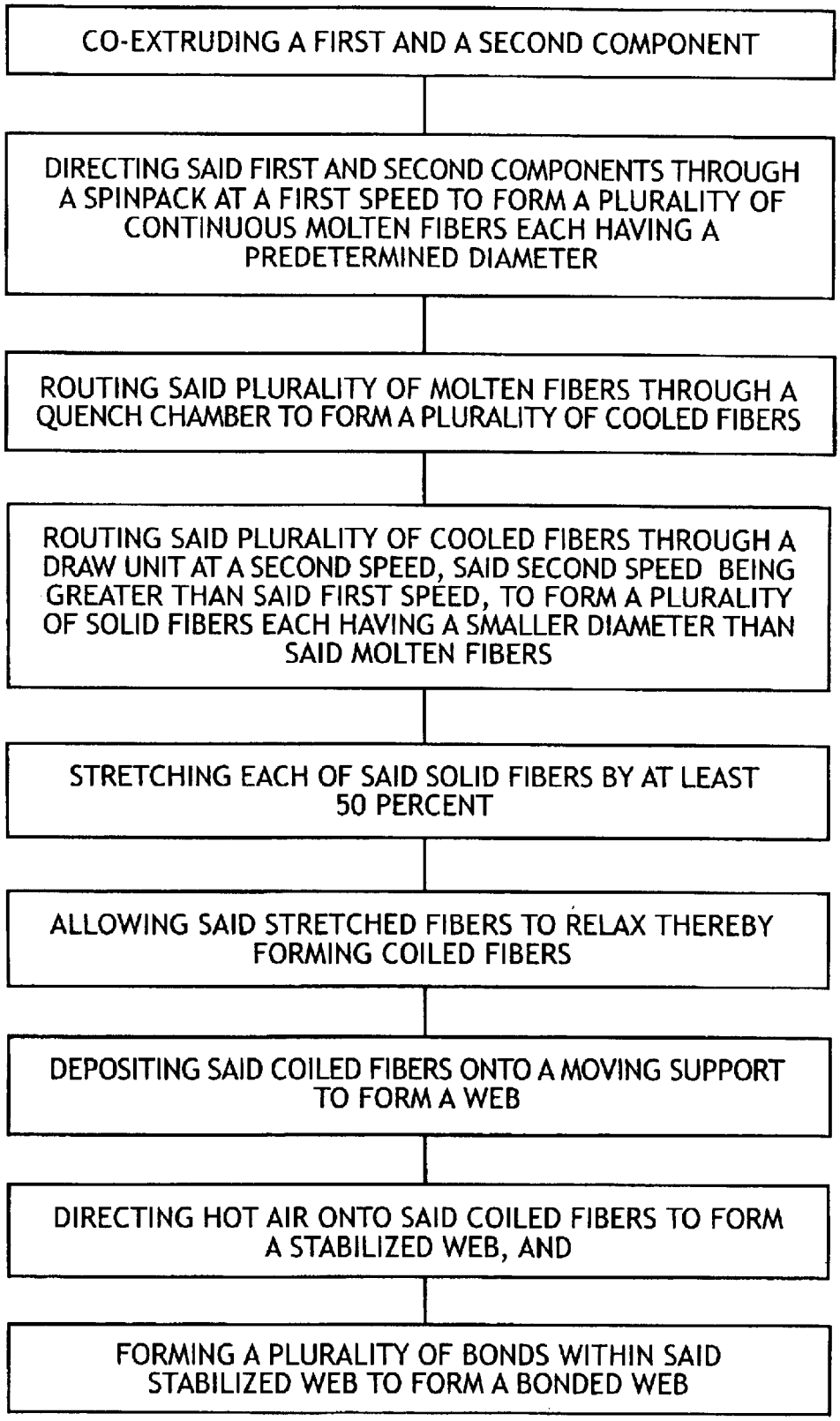
FIG. 8 is a flow diagram of an alternative method of forming fibers into a web.
Figure 9:
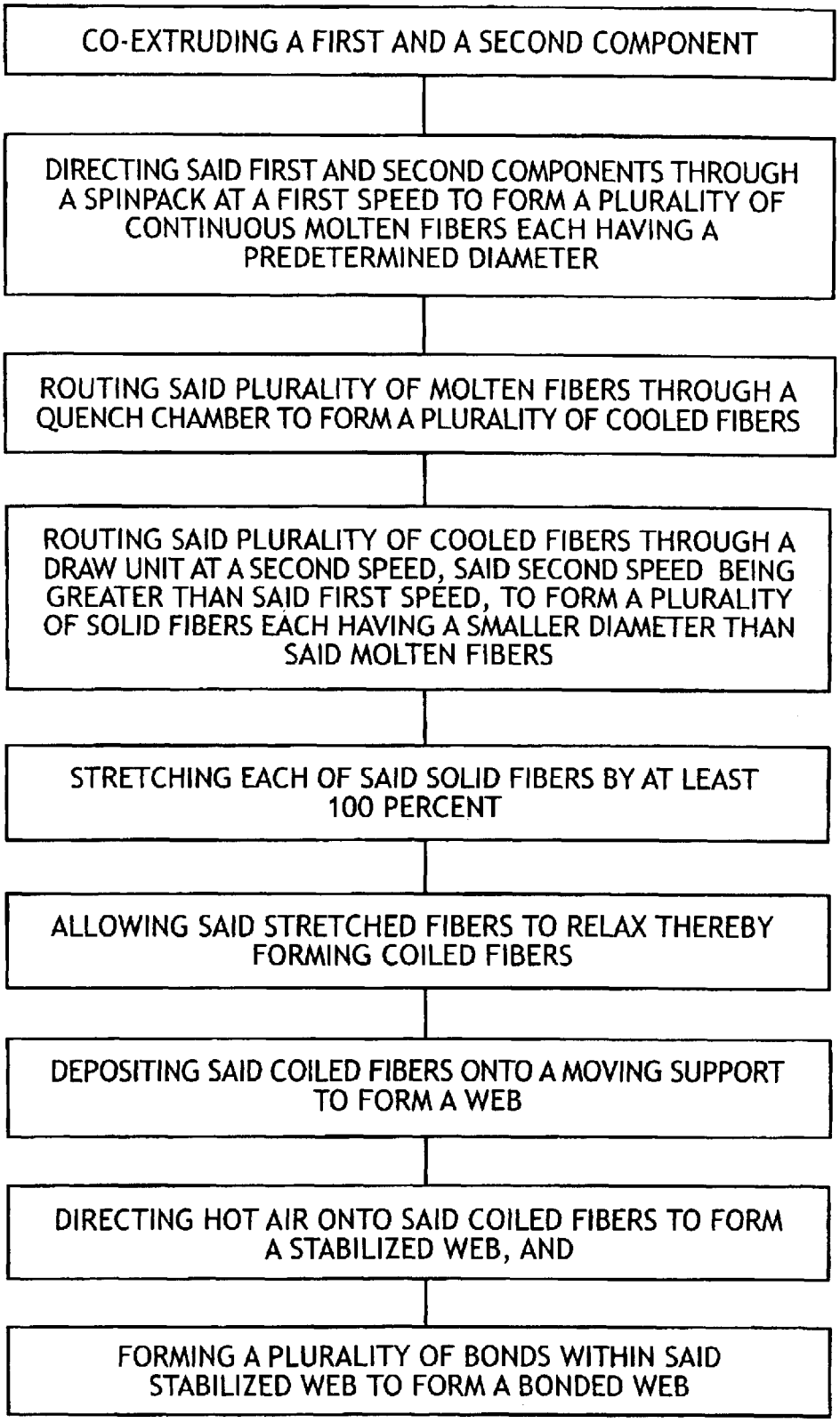
FIG. 9 is a flow diagram of still another method of forming fibers into a web.

Referring now to FIGS. 7–9, flow diagrams depicting the alternative methods of forming bicomponent fibers into a web are shown. These flow diagrams describe the sequence of steps involved in forming the plurality of fibers into a web.

It should be noted that the web 76 can be laminated to a stretchable material, an elastic film or elastic fibers to form a thin, non-absorbent material. This laminate material can be used as the bodyside cover or facing layer on a disposable absorbent article such as a diaper, training pant, incontinence garment, sanitary napkin, etc. This laminate material can also be used in health care products such as wound dressings, surgical gowns, gloves, etc.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

We claim:

1. A method of forming fibers into a web, comprising the steps of:

a) co-extruding a first and a second component, said first component having a recovery percentage $R_1$ and said second component having a recovery percentage $R_2$, wherein $R_1$ is higher than $R_2$;

b) directing said first and second components through a spin pack to form a plurality of continuous molten fibers each having a predetermined diameter;

c) routing said plurality of molten fibers through a quench chamber to form a plurality of cooled fibers;

d) routing said plurality of cooled fibers through a draw unit to form a plurality of solid fibers each having a smaller diameter than said molten fibers;

e) stretching each of said cooled and solid fibers by at least 50 percent;

f) allowing said stretched fibers to relax thereby forming coiled fibers, said coiled fibers having about 50 to about 500 coils per inch, and said first component of each of said coiled fibers adhering to said second component; and g) depositing said coiled fibers onto a moving support to form a web.

2. The method of claim 1 wherein said fibers are bicomponent fibers.

3. The method of claim 2 wherein each of said bicomponent fibers has a core/sheath cross-sectional configuration.

4. The method of claim 1 wherein said first and second components are mechanically adhered to one another.

5. The method of claim 1 wherein said first and second components are chemically adhered to one another.

6. The method of claim 1 wherein said first and second components are physically adhered to one another.

7. The method of claim 1 wherein said web is a spunbond nonwoven web.

8. The method of claim 1 further comprising drawing said plurality of cooled fibers at a speed that is faster than the speed of said molten fibers exiting said spin pack.

9. The method of claim 1 wherein said first component has a volume percent in said web of from about 40% to about 80%.

10. A method of forming bicomponent fibers into a web, comprising the steps of.

a) co-extruding a first and a second component, said first component having a recovery percentage $R_1$ and said second component having a recovery percentage $R_2$, wherein $R_1$ is higher than $R_2$;

b) directing said first and second components through a spin pack at a first speed to form a plurality of continuous molten fibers each having a predetermined diameter;

c) routing said plurality of molten fibers through a quench chamber to form a plurality of cooled fibers;

d) routing said plurality of cooled fibers through a draw unit at a second speed, said second speed being greater than said first speed, to form a plurality of solid fibers each having a smaller diameter than said molten fibers;

e) stretching each of said cooled and solid fibers by at least 50 percent;

f) allowing said stretched fibers to relax thereby forming coiled fibers, said coiled fibers having about 50 to about 500 coils per inch, and said first component of each of said solid fibers adhering to said second component;

g) depositing said coiled fibers onto a moving support to form a web;

h) directing hot air onto said web to form a stabilized web; and i) forming a plurality of bonds within said stabilized web to form a bonded web.

11. The method of claim 10 wherein said first component is a polyester.

12. The method of claim 10 wherein said first component is polylactic acid.

13. The method of claim 10 further comprising bonding said web of stabilized fibers through a nip formed by a pair of bonding rolls to form a bonded web.

14. The method of claim 10 wherein said web has an elongation of up to about 400% in at least one direction.

15. The method of claim 10 wherein said second component is polyolefin.

16. The method of claim 10 further comprising stretching each of said cooled and solid fibers from about 75 percent to about 1,000 percent.

17. The method of claim 10 further comprising stretching each of said cooled and solid fibers from about 100 percent to about 500 percent.

18. The method of claim 10 wherein each of said molten fibers has a predetermined diameter of from about 0.1 millimeter to about 2.0 millimeter.

19. The method of claim 10 wherein said bonded web has an elongation of up to about 200% in at least one direction.

20. A method of forming bicomponent fibers into a web, comprising the steps of:

a) co-extruding a first and a second component, said first component having a recovery percentage $R_1$ and said second component having a recovery percentage $R_2$, wherein $R_1$ is higher than $R_2$;

b) directing said first and second components through a spin pack at a first speed to form a plurality of continuous molten fibers each having a predetermined diameter;

c) routing said plurality of molten fibers through a quench chamber to form a plurality of cooled fibers;

d) routing said plurality of cooled fibers through a draw unit at a second speed, said second speed being greater than said first speed, to form a plurality of solid fibers each, having a smaller diameter than said molten fibers;

e) stretching each of said cooled and solid fibers by at least 100 percent;

f) allowing said stretched fibers to relax thereby forming coiled fibers, said coiled fibers having about 50 to about 500 coils per inch, and said first component of each of said solid fibers adhering to said second component;

g) depositing said coiled fibers onto a moving support to form a web;

h) directing hot air onto said web to form a stabilized web; and i) forming a plurality of bonds within said stabilized web to form a bonded web.

21. The method of claim 20 wherein said coil fibers have a helical configuration.

22. The method of claim 20 further comprising directing several streams of hot air onto said web to form a stabilized web.

23. The method of claim 20 wherein at least one bond per square inch is formed in said bonded web.

24. The method of claim 23 wherein at least 30 bonds per square inch are formed in said bonded web.

25. The method of claim 20 wherein said bonded web has an elongation of up to about 100% in at least one direction.

26. The method of claim 20 wherein said bonded web has an elongation of up to about 400% in two directions.

* * * * *